US007802622B2

(12) United States Patent
Roaldsnes

(10) Patent No.: US 7,802,622 B2
(45) Date of Patent: Sep. 28, 2010

(54) CABLE-PROTECTIVE PIPE SECTION, A METHOD OF PROTECTIVELY ARRANGING AT LEAST ONE CABLE ON THE OUTSIDE OF THE PIPE SECTION AND USE OF A DEVICE FOR PROTECTING THE CABLE

(75) Inventor: Kjartan Roaldsnes, Kverneland (NO)

(73) Assignee: Reslink AS, Algard (NO)

( * ) Notice: Subject to any disclaimer, the term of this patent is extended or adjusted under 35 U.S.C. 154(b) by 169 days.

(21) Appl. No.: 11/813,478

(22) PCT Filed: Dec. 27, 2005

(86) PCT No.: PCT/NO2005/000485

§ 371 (c)(1),
(2), (4) Date: Apr. 24, 2008

(87) PCT Pub. No.: WO2006/073309

PCT Pub. Date: Jul. 13, 2006

(65) Prior Publication Data

US 2009/0126943 A1 May 21, 2009

(30) Foreign Application Priority Data

Jan. 6, 2005 (NO) ..... 20050059

(51) Int. Cl.
*E21B 43/00* (2006.01)
*E21B 17/00* (2006.01)

(52) U.S. Cl. ..... 166/241.1; 166/56; 166/65.1; 166/227

(58) Field of Classification Search ..... 166/56, 166/65.1, 231, 232, 233, 241.1, 241.5, 241.6, 166/277, 378, 380
See application file for complete search history.

(56) References Cited

U.S. PATENT DOCUMENTS

| | | | | |
|---|---|---|---|---|
| 5,343,942 | A | 9/1994 | Del Serra et al. | |
| 5,476,143 | A * | 12/1995 | Sparlin et al. | 166/233 |
| 6,681,854 | B2 | 1/2004 | Danos et al. | |
| 6,848,510 | B2 | 2/2005 | Bixenman et al. | |
| 7,264,061 | B2 | 9/2007 | Dyabevik et al. | |
| 7,278,479 | B2 | 10/2007 | Kvernstuen et al. | |
| 2002/0007948 | A1 | 1/2002 | Bayne et al. | |
| 2002/0053439 | A1 * | 5/2002 | Danos | 166/380 |
| 2002/0092649 | A1 | 7/2002 | Bixenman et al. | |
| 2002/0117304 | A1 | 8/2002 | Gillespie et al. | |
| 2003/0056948 | A1 | 3/2003 | Cameron | |

FOREIGN PATENT DOCUMENTS

GB 2382831 A 6/2003

* cited by examiner

*Primary Examiner*—David J Bagnell
*Assistant Examiner*—Michael Wills, III
(74) *Attorney, Agent, or Firm*—Van Someren, PC; Rodney V. Warfford; David G. Matthews

(57) ABSTRACT

A technique protectively arranges at least one cable on the outside of and along at least one pipe section of a pipe string. The cable is secured to at least one cable protector coupled to the outside of at least one pipe section of the pipe string. The cable protector comprises a cable-retaining strip. The cable-retaining strip is provided with at least one continuous cable track arranged along the cable-retaining strip, the cable track opening outwards relative to the pipe section. The at least one cable is also secured to the at least one cable track, whereby the cable is protected from the external environment.

8 Claims, 4 Drawing Sheets

CABLE-PROTECTIVE PIPE SECTION, A METHOD OF PROTECTIVELY ARRANGING AT LEAST ONE CABLE ON THE OUTSIDE OF THE PIPE SECTION AND USE OF A DEVICE FOR PROTECTING THE CABLE

CROSS-REFERENCE TO RELATED APPLICATIONS

This application is the U.S. national stage application of International Application PCT/NO2005/000485, filed Dec. 27, 2005, which International Application was published on Jul. 13, 2006, as International Publication No. WO 2006/073309 A1 in the English language. The International Application claims priority of Norwegian Patent Application 20050059, filed Jan. 6, 2005.

BACKGROUND OF THE INVENTION

The present invention regards a cable-protective pipe section of a pipe string for a well.

The invention also regards a method of protectively arranging at least one cable on the outside of and along at least one pipe section of said pipe string. The invention is suitable for arranging the at least one cable in an essentially jointless manner along the pipe section.

The invention also regards the use of a cable protection device (cable protector) for securing the cable along said pipe section.

The well may be e.g. a petroleum well or an injection well, while the pipe string may be e.g. a completion string in the form of a production string or an injection string. In the position of use, such a string and such a cable will typically extend from the surface and down into at least one underground reservoir section. The invention is particularly advantageous for protecting cables in connection with open hole completions in so-called smart wells. Such smart wells may be provided with various types of equipment for monitoring, controlling and influencing well parameters and/or conditions. In other respects, use of the invention is not limited to open hole completions or smart wells, and it may equally be used in other types of wells and also cased well sections.

Upon completion of a well such as a smart well there will often be a need to pass one or more cables or cable assemblies along the well completion string. The completion string is arranged in one or more underground reservoir sections. Typically such cables are used to convey signals, power and/or fluids between the surface and equipment associated with the completion string. The signals may be control and/or measurement signals transmitted to/from various equipment in the completion string. Thus the equipment in the string may comprise, among other things, measuring instruments, sensors, actuators, valves, seals, pumps and motors. The cables can also be used to transmit driving power, e.g. electric and hydraulic power, to some of this equipment. Such cables can also be used to convey fluids such as liquids, gases, chemicals and reservoir fluids between the surface and the completion string. For the latter purpose the completion string is provided with appropriate inlet ports and/or outlet ports arranged in suitable positions along the completion string, and through which said fluids can flow when required.

As said cables are typically secured on the outside of and along the completion string, the cables will be especially vulnerable to different types of loads and associated damages that may occur both during and following the deployment of the completion string in the well. These damages may occur e.g. as a result of mechanical loads and/or erosion connected with fluid flow. This is the case especially in connection with open hole completions, where the completion string is placed in an open wellbore, and where the cables are exposed directly to an uncased formation wall, which often exhibits an uneven and rough surface, and thereby to the prevailing conditions in the wellbore. Thus there is a need to protect such external cables.

In order to avoid or reduce the loading on and damage to external cables the cables are generally arranged to be quite robust. Thus robustness can be achieved through e.g. appropriate dimensioning, choice of materials and optionally protection of the cable or cables in question. This may require a lot of well space, thus contributing to an increase in well completion costs.

The most common method of passing cables down to an open reservoir section in a well is first to install a protective and perforated well string, and optionally at least one sand screen, in the reservoir section. The completion string with cables attached, e.g. in a smart well, is the installed inside the protective pipe string, or possible inside the at least one sand screen. In this connection, different zones along the completion string are separated by means of appropriate production packers, and appropriate valves can control the fluid flow into or out of the completion string.

Norwegian patent NO 316288 describes a suitable technical solution for jointless attachment of such a cable to a pipe string by means of a split packing fixed to the outside of the pipe string.

Alternatively, and in accordance with Norwegian patent NO 314005, such cables may be passed through conduits such as protective pipes arranged between peripherally distributed and axially extending spacer strips inside a sand screen. The spacer strips are arranged between a perforated inner base pipe and an outer sand screen jacket consisting of peripheral metal wire windings.

The completion string according to the above prior art will then require the installation of two pipe strings in the open reservoir section; an outer and an inner pipe string. This completion procedure must be carried out in two independent installation operations, which is inexpedient both in terms of equipment use, expenditure of time, and costs associated with this. In terms of fluidics, this type of pipe assembly will also result in a reduced cross-section of flow for the flowing fluids. This causes an undesirable loss of fluid pressure and thereby an undesirable reduction in fluid flow rate through the completion string. Cables placed across from perforations in the protective outer pipe string will also be particularly vulnerable to erosion associated with fluid flow through said perforations.

If a pipe string fitted with a sand screen, according to NO 314005, is used in the completion of a well, the individual sand-screen-fitted base pipes must be screwed together to form a compound pipe string. Such single pipes will typically have a limited length of approximately 12 metres, and so passing a cable between said spacer strips in the sand screen of the pipe may necessitate splicing of the cable. Such a splicing operation introduces a risk of leakage in fluid bearing cables, or possibly short-circuiting of or interference in signal transmitting cables, and prolongs the installation procedure, which is undesirable both from a technical and financial point of view.

BRIEF SUMMARY OF THE INVENTION

The object of the invention is to reduce the above disadvantages of prior art as far as possible by providing efficient and cost saving solutions for simpler and improved protection of cables on the outside of at least one pipe section of a pipe string. An object of the invention is also to arrange the at least one cable to be as continuous and jointless as possible along said at least one pipe section.

The object is achieved by characteristics as stated in the following description and the following claims.

According to one aspect of the invention, the object is achieved by fitting a pipe string for a well with at least one cable-protective pipe section. At least one cable of the above-mentioned type is arranged on the outside of and along the pipe string. The at least one cable is attached to at least one cable protector coupled to the outside of the at least one pipe section, and where the cable protector is stretched along this.

What is characteristic about the at least one pipe section is that said cable protector is constituted by a cable-retaining strip provided with at least one continuous cable track. The cable track is arranged along the cable-retaining strip and opens outwards relative to the pipe section. In addition, the at least one cable is secured to the at least one cable track, whereby the cable is protected from the external environment.

If a cable-retaining strip contains two or more cables, at least two cables may be assembled to form a cable assembly.

One or more cables, e.g. said cable assembly, may be embedded in a sheath made from a flexible material. Externally the cable sheath is shaped as a strip to fit into a cable track in the cable-retaining strip.

The interfacing contact surfaces of the cable-sheathing strip and the cable track can also have complementary shapes. Furthermore, the cable track and the cable-sheathing strip can be designed so as to be interlocking along at least one portion of the interfacing contact surfaces. In the position of use, they are interconnected as a result of their interlocking design. Seen in cross section, the cable-sheathing strip and the cable track may take the shape of e.g. a truncated cone or a similar locking design, which in the position of use lockingly interconnects the cable-sheathing strip and the cable track. However, such interlocking designs may require a special tool to force said strip into the cable track.

Additionally, or alternatively, the cable-retaining strip may be provided with at least one fastener that, at least while in the position of use, retains the at least one cable in the at least one cable track. The fastener can be a quick release coupling such as a clip. The quick release coupling can also be a deflecting lip that, in the position of use, is at least partially bent over the cable or the cable assembly in the cable track.

The fastener can also be a protective cover that, at least in the position of use, is coupled to the cable-retaining strip, and which at least partially covers the at least one cable in the at least one cable track. If required the protective cover may be releasably, e.g. rotatably, connected to the cable-retaining strip.

Such a protective cover may as an example be used with a cable-sheathing strip and a cable track constructed so as to be interlocking along at least one portion of their interfacing contact surfaces. Such locking can be realized by one long side of the cable-sheathing strip and a corresponding long side of the cable track having a wedge-shaped cross section, the wedge forming an acute angle at the bottom of the cable track. Viewed in cross section, the other long side of the cable-sheathing strip and the corresponding other long side of the cable track are constructed to be non-interlocking, e.g. with a rectangular cross sectional shape. In the position of use, the protective cover will cover and lock at least one portion of said other long side. This type of technical solution will facilitate the installation of the cable-sheathing strip in the cable track.

Moreover, the cable-retaining strip may be welded, riveted, glued, soldered or screwed to the pipe section. The cable-retaining strip can also be secured to the pipe section by at least one fixing strap. The fixing strap may be arranged around the cable-retaining strip, or it may be secured to the cable-retaining strip and, in the position of use, also be fastened to the pipe section. The fixing strap may secure the cable-retaining strip to the pipe section through welding, riveting, gluing, soldering, screwing and/or clamping. Other known fastening devices and/or fixing methods can also be used.

Moreover, in a preferred embodiment the cable-retaining strip can be a strip section formed with an axially extending and radially projecting middle portion into which the at least one cable track is recessed. Each peripheral edge of the strip section may be provided with an axially extending side member for fastening. The side member may be e.g. welded, riveted, glued, soldered or screwed to the pipe string.

Additionally at least one pipe section of the pipe string may comprise an inner base pipe string around which is peripherally arranged at least one outer sand screen. According to the invention, said at least one cable-retaining strip can be coupled to the outside of said at least one sand screen. Such a sand screen comprises several axially extending and peripherally distributed spacer strips that are attached to the outside of the base pipe string, and which are arranged to project radially from this. Peripheral metal wire windings are spaced apart in the axial direction and fastened to the outside of these spacer strips. This embodiment of the invention is particularly suitable for open hole completions, especially when the pipe section is located in relatively unconsolidated and loose reservoir rocks.

Each and all spacer strips in the sand screen may be arranged to project the same radial distance (also termed radial height) from the base pipe string. This means that the at least one cable-retaining strip also projects a specific radial distance (radial height) from the base pipe string. Alternatively the sand screen can be provided with extraordinary high spacer strips so as to create extraordinary large axial fluid flow paths between the spacer strips. This is particularly advantageous when it comes to promoting continuous fluid flow through several interconnected sand screen sections. Such sand screens have circular cross sections.

In some instances however, it is necessary to minimize the protrusion of the cable-retaining strip from the base pipe string, e.g. when passing a completion string through well pipes and/or equipment with small internal apertures and/or into a small bore open hole. Under these circumstances the sand screen spacer strips can be arranged to project different radial distances (or radial heights) from the base pipe string and around its circumference. This leaves room for countersinking of at least one cable-retaining strip into the sand screen construction while maintaining an outer dimension for the pipe section which is approximately the same as that of a sand screen-fitted pipe section with no cable-retaining strip fixed to the outside. Therefore, under these circumstances, spacer strips located in a peripheral part radially inwards of a cable-retaining strip will be arranged to project a smaller radial distance from the base pipe string than the rest of the spacer strips around this. By doing so, the cable-retaining strip will also project a smaller radial distance from the base pipe string and therefore be recessed slightly in the sand screen.

A sand screen of a non-circular cross section will then have axial fluid flow paths of a relatively large radial extent outside the recessed portion(s) of this, and will consequently have an optimum flow profile along these fluid flow paths.

Additionally, the at least one pipe section may be arranged in a completion string for said well. Such a completion string may be a production string or an injection string.

According to another aspect of the invention, the object of the invention is achieved by means of a method of protectively arranging at least one cable on the outside of and along at least one pipe section of a pipe string for a well. The at least one cable is secured to at least one cable protector that is coupled to the outside of the at least one pipe section.

The method is characterized in that it comprises the following steps:

using a cable-retaining strip as said cable protector;

providing the cable-retaining strip with at least one continuous cable track extending along the cable-retaining strip;

coupling the at least one cable-retaining strip to the outside of the at least one pipe section of the pipe string, and also coupling the cable-retaining strip with said cable track opening outwards relative to the pipe section; and securing the at least one cable in the at least one cable track in order to protect said cable from the external environment.

If a cable-retaining strip holds two or more cables, at least two cables can be assembled into a cable assembly.

One or more cables, e.g. said cable assembly, can be embedded in a sheath made from a flexible material. Externally, the sheath is shaped as a strip to fit a cable track in the cable-retaining strip.

The cable-sheathing strip and the cable track may also be formed with complementary interfacing contact surfaces. In addition the cable track and the cable-sheathing strip may be constructed so as to interlock along at least one portion of their interfacing contact surfaces, whereby, when in the position of use, they are interconnected as a result of their interlocking construction. Seen in cross section, the cable-sheathing strip and the cable track may take the shape of e.g. a truncated cone or a similar locking design, which in the position of use lockingly interconnects the cable-sheathing strip and the cable track.

Additionally, or alternatively, the at least one cable can be secured to said cable track by at least one fastener associated with the cable-retaining strip. The cable can be fastened by at least one quick release coupling such as a clip. The cable may also be fastened by means of at least one deflecting lip that is, at least partially, bent over the cable in the cable track, retaining this when in the position of use.

The cable may also be fastened by means of a protective cover that, at least when in the position of use, is coupled to the cable-retaining strip and which is brought to cover the at least one cable in the at least one cable track, at least partially. If required, the protective cover may be releasably, e.g. rotatably, coupled to the cable-retaining strip.

Said protective cover may be used e.g. with a cable-sheathing strip and a cable track designed so as to be interlocking along at least one portion of their interfacing contact surfaces. Such locking can be realized by one long side of the cable-sheathing strip and a corresponding long side of the cable track having a wedge-shaped cross section, the wedge forming an acute angle at the bottom of the cable track. Viewed in cross section, the other long side of the cable-sheathing strip and the corresponding other long side of the cable track are constructed so as to be non-interlocking, e.g. with a rectangular cross sectional shape. In addition, the protective cover is brought to cover and lock at least one portion of said other long side when in the position of use.

Moreover, the cable-retaining strip may be welded, glued, soldered or screwed to the pipe section. The cable-retaining strip can also be secured to the pipe section by at least one fixing strap. The fixing strap may be arranged around the cable-retaining strip, or it may be secured to the cable-retaining strip and, in the position of use, also be fastened to the pipe section. The fixing strap may secure the cable-retaining strip to the pipe section by welding, riveting, gluing, soldering, screwing and/or clamping. Other known fastening devices and/or fixing methods can also be used. The at least one cable-retaining strip can be attached to individual pipe lengths of the pipe string prior to their transport to the well site. Alternatively, the cable-retaining strip(s) may be attached to the at least one pipe section at the well site, e.g. in connection with the deployment of the pipe string in the well.

In a preferred embodiment the cable-retaining strip can be formed as a strip section having an axially extending and radially projecting middle section into which said at least one cable track is recessed. Each peripheral edge of the strip section may be provided with an axially extending side member for fastening, which, as an example, can be welded to the pipe string.

Additionally, at least one pipe section of the pipe string can be arranged with an inner base pipe string around which is peripherally arranged at least one outer sand screen. According to the invention, said at least one cable-retaining strip is coupled to the outside of the pipe section. The construction of such a sand screen is described above. This step of the embodiment is particularly advantageous, especially in connection with loose reservoir rocks.

Additionally, all spacer strips can be arranged to project the same radial distance from the base pipe string.

Alternatively, spacer strips that are arranged in a peripheral part radially inwards of a cable-retaining strip can be arranged to project a smaller radial distance from the base pipe string than the rest of the spacer strips around this. By so doing, the cable-retaining strip will also project a smaller radial distance from the base pipe string and so be recessed slightly into the sand screen.

According to the present method, the at least one pipe section can be arranged in a completion string for said well, e.g. in a production string or in an injection string.

According to a third aspect of the invention, the objective of the invention is achieved by using at least one cable-retaining strip provided with at least one continuous and outwardly open cable track, in order to secure at least one cable along at least one pipe section of a well pipe string, including a completion string, where the cable-retaining strip is connected to the outside of the pipe section and protects the cable from the external environment.

BRIEF DESCRIPTION OF THE SEVERAL VIEWS OF THE DRAWING(S)

The following describes non-limiting examples of embodiments of the present invention, with reference to the accompanying figures, in which.

The appended figures are schematic in nature and may be slightly distorted with regard to the shapes, relative dimensions and mutual positioning of the components. In the following, identical details in the figures will be indicated by the same reference number.

DETAILED DESCRIPTION OF THE INVENTION

Figure 1:
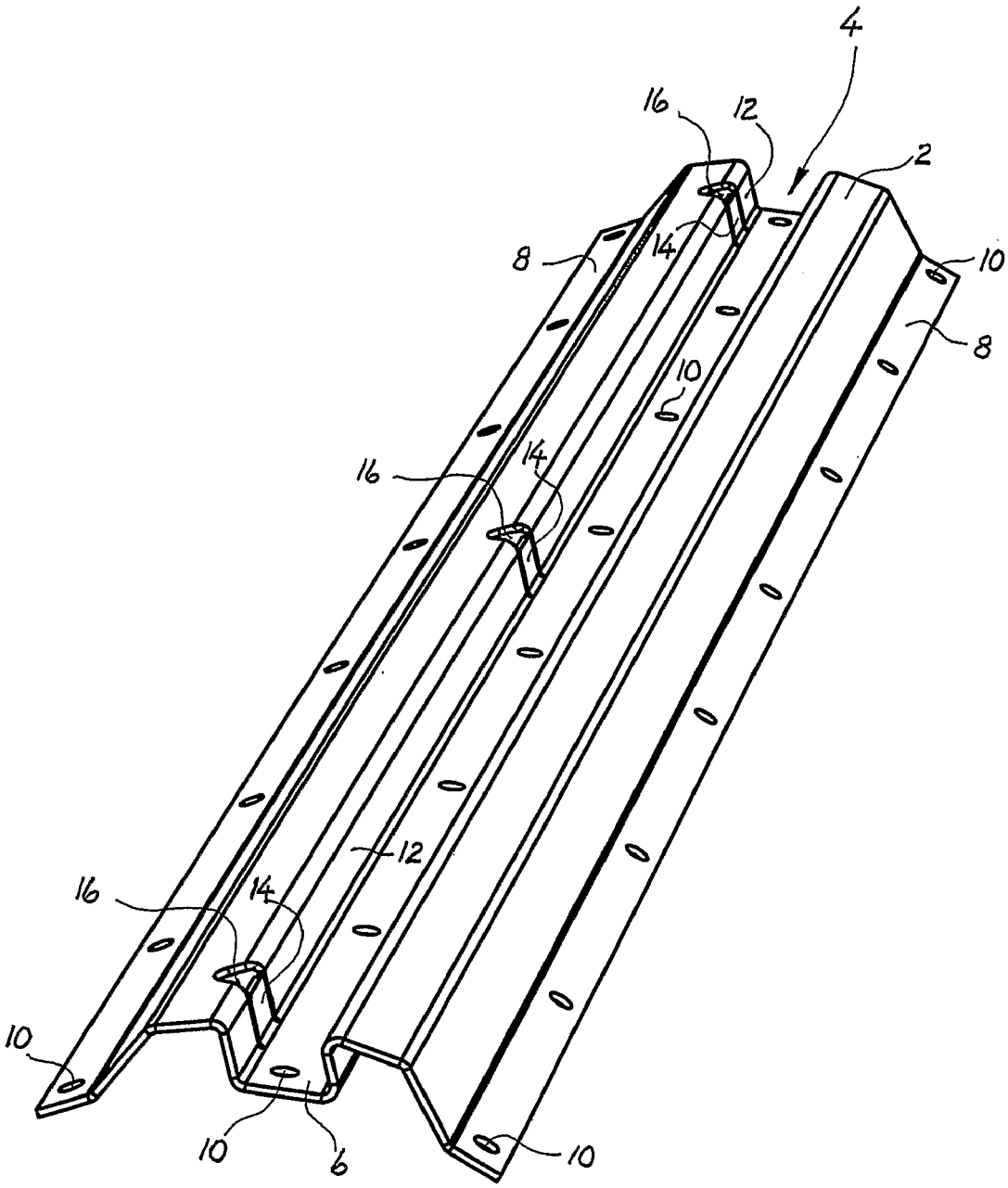
FIG. 1 is a perspective drawing of a cable-retaining strip in the form of a strip section.

FIG. 1 shows a cable-retaining strip according to the invention and in the form of a strip section 2. The moulding 2 is formed within axially extending and radially projecting middle section 4 into which is recessed a longitudinally extending continuous cable track 6. The cable track 6 opens outwards in the radial direction. Furthermore, each peripheral edge of the strip section 2 is formed with an axially extending attaching side member 8, one on either side of the middle section 4. Both the attaching members 8 and the cable track 6 are provided with successive holes 10 wherein the moulding 2 is welded to an underlying pipe or a sand screen.

In this example of an embodiment one side wall 12 of the cable track 6 is provided with successive deflecting lips 14. In other embodiments, several walls that define the cable track 6 may be provided with deflecting lips 14 or other appropriate fasteners, e.g. clips that are fitted to the outside of a cable and fastened to the moulding 2. In this embodiment each deflecting lip 14 forms part of the sidewall 12, being flush with this when inactive. Above each deflecting lip 14, at the upper end of the sidewall 12, the strip section 2 is provided with an opening 16. When at least one cable is arranged in the cable track 6 a suitable tool may be brought in through the opening 16 to bend the deflecting lip 14 over the cable in order to lock this in the cable track 6 when in the position of use. This is shown in FIGS. 2-6.

Figure 2:
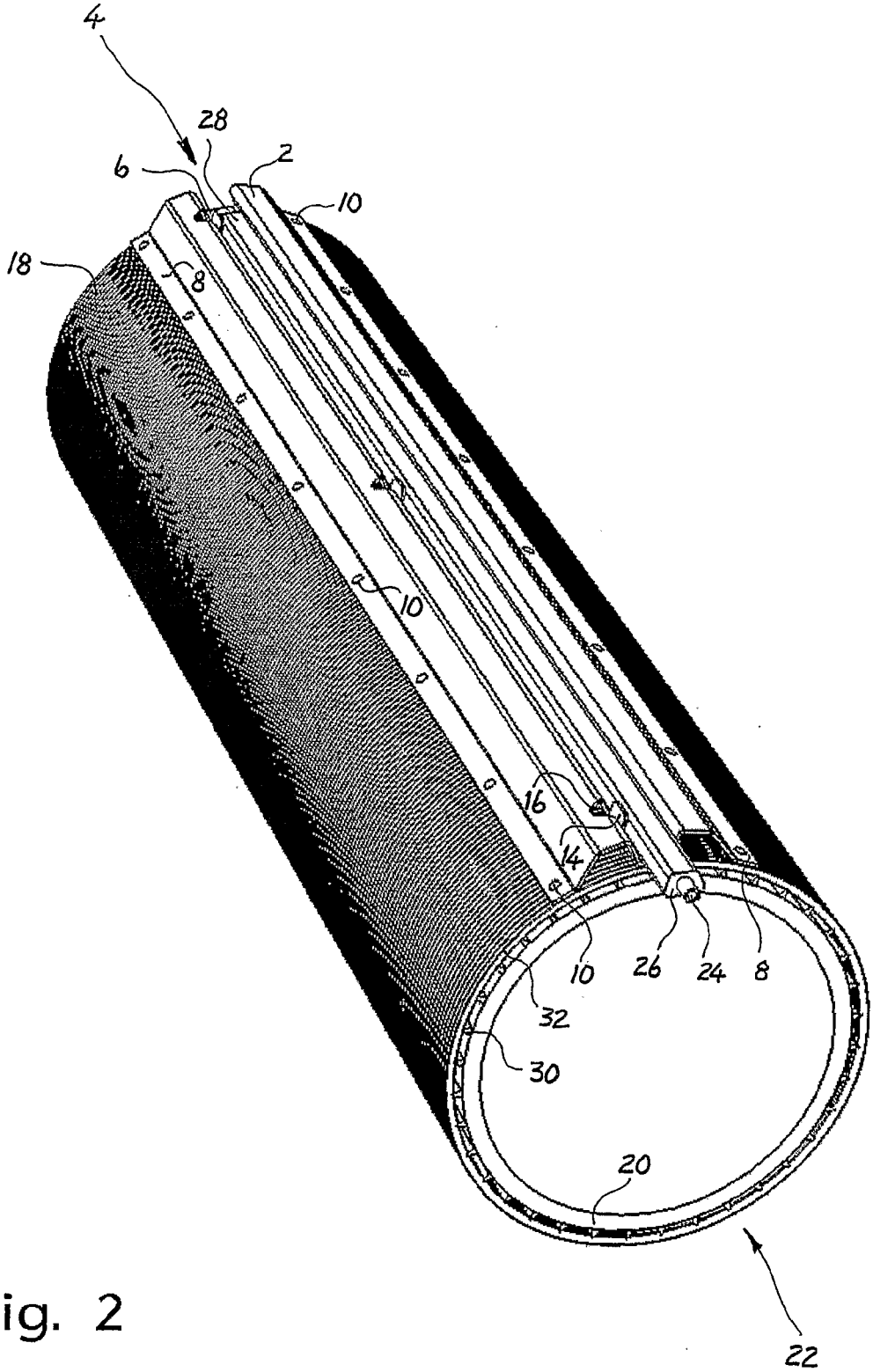
FIG. 2 shows a perspective view of the strip section of FIG. 1 on a smaller scale, fixed to the outside of a typical sand screen and provided with one cable in the cable track.
Figure 3:
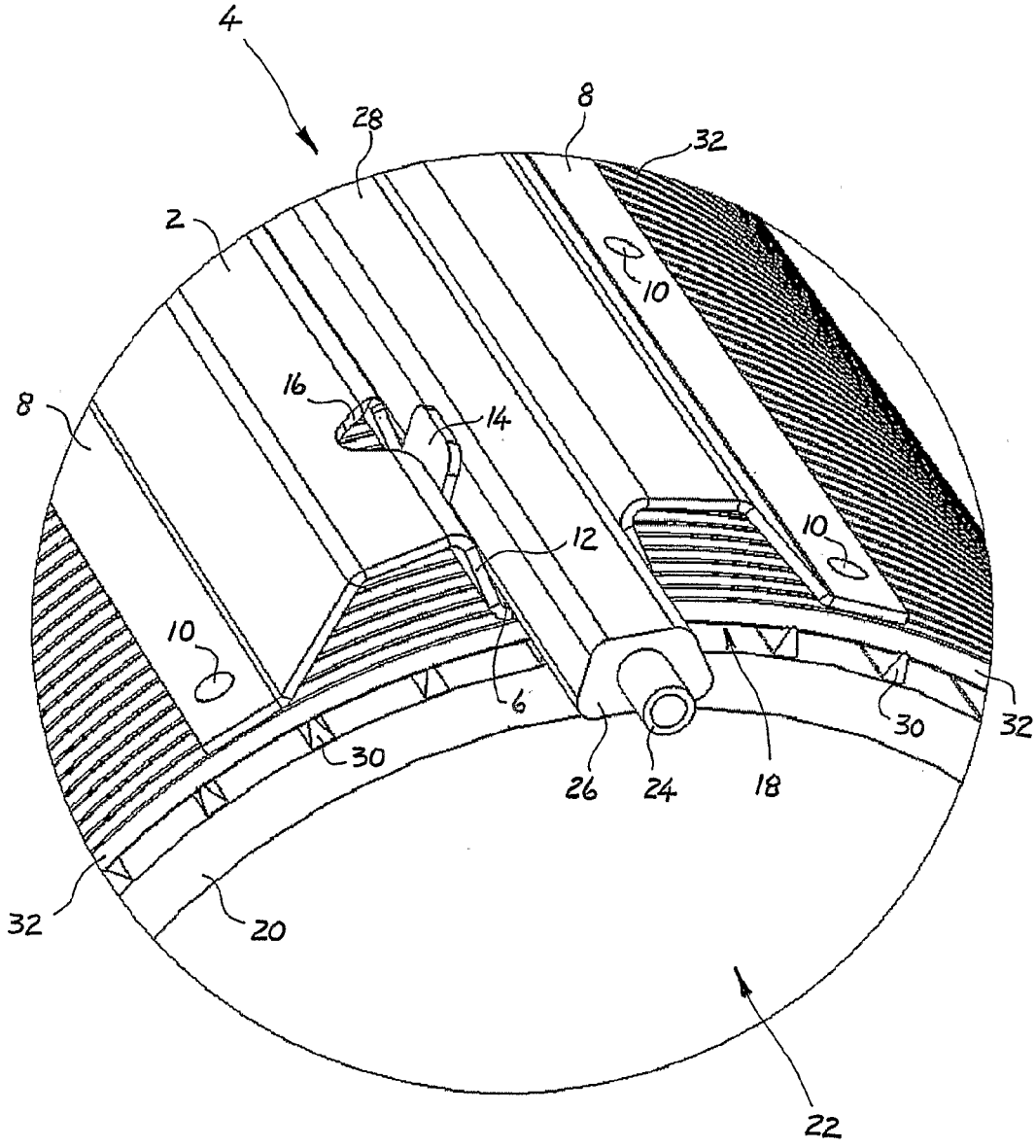
FIG. 3 shows a section of the strip section of FIG. 2 on a larger scale.

FIGS. 2 and 3 shows the strip section 2 welded to the outside of a typical sand screen 18 arranged peripherally about an inner base pipe string 20 of a pipe section 22 of a completion string for a well. The base pipe string 20 may be provided with through perforations (not shown) for allowing reservoir fluids to flow through the sand screen 18 and into the base pipe string 20 in the completion string. Alternatively, fluids may flow along such a sand screen 18 and onwards in the axial direction via at least one further sand screen section, then to flow into the base pipe string 20 via perforations (not shown) and/or at least one valve device (not shown) in this. A pipe type cable 24 is embedded into a plastic sheath 26, and together they form a continuous sheathing strip 28, the outer shape of which fits in the cable track 6, as shown in FIGS. 2 and 3. Other types of cable can also be embedded in this type of plastic sheath 26. The cable-sheathing strip 28 is locked in the cable track 6 by said deflecting lips 14, which in the position of use are bent over the sheathing strip 28 in a locking configuration.

In addition, the sand screen 18 comprises axially extending and peripherally distributed spacer strips 30, which in this embodiment have a triangular cross section, placed on the outside of the base pipe string 20, the points of the triangles projecting radially from this. Axially spaced peripheral metal wire windings 32 are wound on the outside of and spot-welded to the spacer strips 30. Said axial spacing between the windings 32 is sufficiently large to allow fluid flow through, but sufficiently small to prevent solids from entering the sand screen 18. This type of sand screen construction constitutes prior art.

Figure 4:
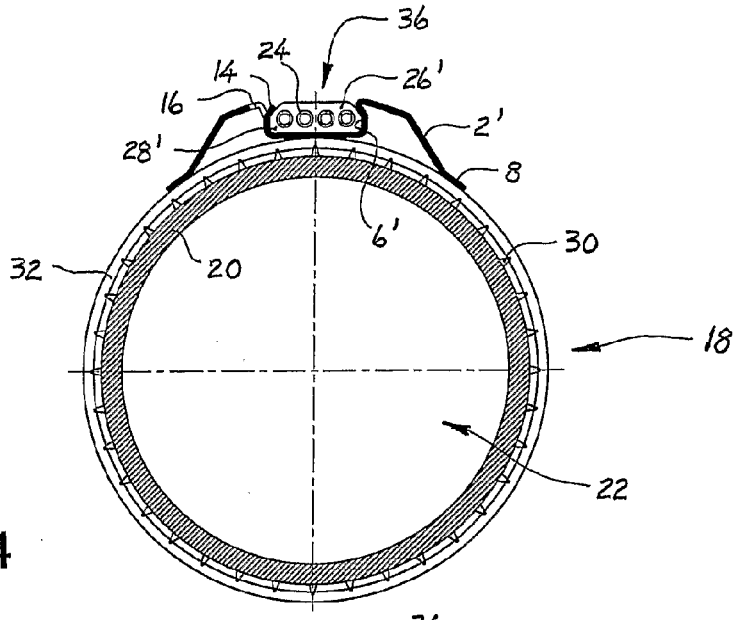
FIG. 4 shows a smaller scale cross sectional view through a typical sand screen onto which said strip section is secured, the cable track of the moulding being provided with a cable assembly containing four cables embedded in a sheath made of flexible material.

FIGS. 2-4 show a sand screen 18 provided with spacer strips 30 that all project the same radial distance from the base pipe string 20, giving the sand screen 18 a circular cross section.

Figure 5:
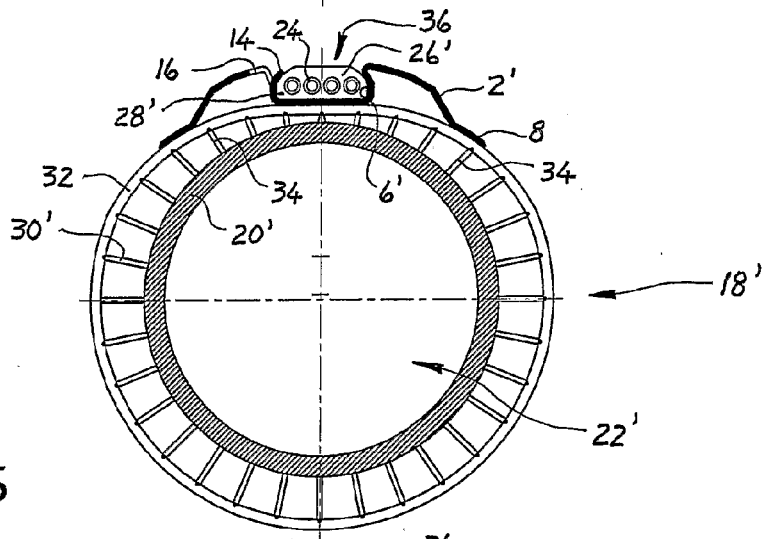
FIG. 5 shows a cross sectional view of the strip section of FIG. 4, fixed to the outside of one recessed peripheral part of a sand screen.
Figure 6:
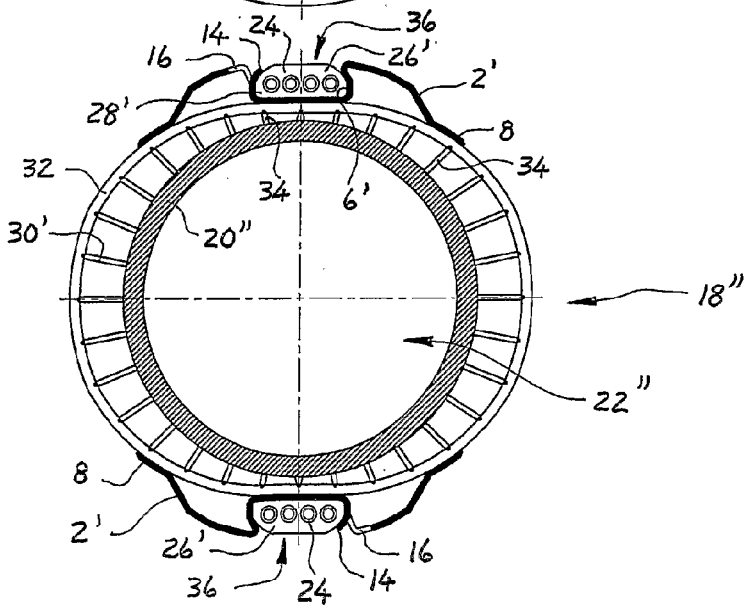
FIG. 6 shows a cross sectional view of two strip sections according to FIG. 4 fixed to the outside of separate recessed peripheral parts of a sand screen.

FIGS. 5 and 6 on the other hand, show two sand screens 18' and 18" with non-circular cross sections, and which are purpose-made sand screens. The sand screen 18' is arranged on the outside of a base pipe string 20' of a pipe section 22', while the sand screen 18" is arranged on the outside of a base pipe string 20" of a pipe section 22". These examples of embodiments employ base pipe strings 20', 20" of a smaller diameter than the base pipe string 20 of FIGS. 2-4. However, most of the surrounding spacer strips 30' of the base pipe strings 20', 20" project further from the base pipe strings 20', 20" in the radial direction than the equally sized spacer strips 30 around the previous base pipe string 20. The overall radial distance for the smaller base pipe string 20', 20" and its larger spacer strips 30' is approximately the same as for the previous base pipe string 20. Thereby each pipe section 22', 22" can be arranged to have approximately the same external dimension as the pipe section 22, cf. FIGS. 4-6.

Furthermore the sand screen 18' has one strip section 2' welded to it, while the sand screen 18" has two diametrically opposite strip sections 2" welded to it. On the other hand, spacer strips 34 in a peripheral part arranged radially inwards of a strip section 2' project a smaller radial distance from the base pipe string 20', 20" than the other spacer strips 30' around this. Consequently the strip section 2' is recessed slightly into inner structure of the sand screen 18', 18", cf. FIGS. 5 and 6.

The sand screens 18, 18', 18" of FIGS. 4, 5 and 6, respectively, are all provided with strip sections 2', each of which has a cable track 6'. Each cable track 6' holds a cable assembly 36 consisting of four pipe type cables 24 embedded in a flexible plastic sheath 26'. Altogether the cable assembly 36 is formed as a continuous cable-sheathing strip 28', the external shape of which fits in the cable track 6', as shown in FIGS. 4-6. In these examples the cable-sheathing strip 28' is locked into the cable track 6' by means of said deflecting lips 14 of the strip section 2'.

Preferably the strip section 2, 2' is pre-installed on the sand screen 18, 18', 18" prior to its arrival at the well site. The cable-sheathing strip 28, 28' may for instance be coiled on a drum for deployment. During the deployment of the completion string in the well successive pipe lengths of the string, including sand screens 18, 18', 18", are joined consecutively and lowered into the well. In order to ensure that the strip section 2, 2' on one pipe length is aligned with the strip section 2, 2' on the next pipe length after these have been joined, the end portions of the pipe lengths can be fitted with specially marked and specially designed threads, which represents a previously known threading and coupling technique. Such special threads help to ensure that successive lengths of the strip section 2, 2' are arranged linearly. The cable-sheathing strip 28, 28' is deployed and secured in the strip section 2, 2' or a similar cable-retaining strip. At the same time, individual cables 24 are consecutively terminated in associated equipment or ports connected with the pipe section 22, 22', 22". Preferably the cable-sheathing strip 28, 28' is coupled only to the outside of the lowermost pipe string section of the completion string, which section will be placed in an open, uncased wellbore. Between this section and the surface cables may be attached to the pipe string by means of e.g. said split packing described in NO 316288.

The invention claimed is:

1. A cable-protective pipe section intended for incorporation in a pipe string of a well;

wherein at least one cable-retaining strip is attached along an outside of said pipe section;

wherein the cable-retaining strip includes at least one continuous cable track for receiving and protecting at least one cable therein, said cable track being open in an outward direction, characterized in that the at least one cable-retaining strip is comprised of a strip profile formed with an axially extending and projecting middle section within which said cable track is recessed;

wherein the at least one strip profile is provided with at least one quick coupler device for attaching said cable within the cable track, the quick coupler device for attaching said cable within the cable track is comprised of a deflection lip that may be selectively transitioned over the cable to hold the cable in the cable track;

wherein at least one peripheral side edge of the strip profile is provided with an axially extending and supporting side member; and wherein the at least one strip profile is attached along an outside of a sand screen arranged around an inner base pipe string of said pipe section.

2. The cable-protective pipe section according to claim 1, wherein said quick coupler device for attaching said cable within the cable track is comprised of the deflection lip which is selectively bent with a tool for complete or partial deflection over the cable when placed within the cable track.

3. The cable-protective pipe section according to claim 1, wherein the strip profile is welded, riveted, glued, soldered or screwed to said sand screen.

4. The cable-protective pipe section according to claim 1, wherein the sand screen comprises several axially extending and peripherally distributed spacer strips fixed to the outside of said base pipe string and projecting radially outwards therefrom; and wherein peripheral metal wire windings are fixed onto said spacer strips at an axial distance from one another so as to form a flow-through screen structure.

5. The cable-protective pipe section according to claim 4, wherein all spacer strips project outwards from the base pipe string at an equal radial distance.

6. A cable-protective pipe section intended for incorporation in a pipe string of a well;

wherein at least one cable-retaining strip is attached along an outside of said pipe section;

wherein the cable-retaining strip includes at least one continuous cable track for receiving and protecting at least one cable therein, said cable track being open in an outward direction, characterized in that the at least one cable-retaining strip is comprised of a strip profile formed with an axially extending and projecting middle section within which said cable track is recessed;

wherein the at least one strip profile is provided with at least one quick coupler device for attaching said cable within the cable track;

wherein at least one peripheral side edge of the strip profile is provided with an axially extending and supporting side member; and wherein the at least one strip profile is attached along an outside of a sand screen arranged around an inner base pipe string of said pipe section, the sand screen comprising several axially extending and peripherally distributed spacer strips fixed to the outside of said base pipe string and projecting radially outwards therefrom; and wherein peripheral metal wire windings are fixed onto said spacer strips at an axial distance from one another so as to form a flow-through screen structure, wherein the spacer strips are located in a peripheral part radially inwards of the strip profile, and project outwards from the base pipe string at a smaller radial distance than that of the other spacer strips distributed therearound, whereby also the strip profile projects from the base pipe string at a smaller radial distance.

7. The cable-protective pipe section according to claim 6, wherein said quick coupler device for attaching said cable within the cable track is comprised of a deflection lip which is selectively bent with a tool for complete or partial deflection over the cable when placed within the cable track.

8. The cable-protective pipe section according to claim 6, wherein the strip profile is welded, riveted, glued, soldered or screwed to said sand screen.

* * * * *